US006245382B1

(12) United States Patent
Shvartsman et al.

(10) Patent No.: US 6,245,382 B1
(45) Date of Patent: Jun. 12, 2001

(54) METHOD FOR MAKING PROTECTIVE FILM

(75) Inventors: Felix P. Shvartsman, Eden Prairie; Roman T. Knipp, Stillwater, both of MN (US)

(73) Assignee: DataCard, Inc., Minnetonka, MN (US)

( * ) Notice: Subject to any disclaimer, the term of this patent is extended or adjusted under 35 U.S.C. 154(b) by 0 days.

(21) Appl. No.: 09/256,950

(22) Filed: Feb. 24, 1999

(51) Int. Cl.[7] ..... B05D 5/10

(52) U.S. Cl. ..... 427/208.2; 427/208.8; 427/412.1; 427/42.5; 427/420; 427/428

(58) Field of Search ..... 427/208.8, 208.2, 427/412.1, 412.5, 420, 428

(56) References Cited

U.S. PATENT DOCUMENTS

| | | | |
|---|---|---|---|
| 3,838,252 | | 9/1974 | Hynes et al. . |
| 4,397,707 | * | 8/1983 | Dawdy . |
| 4,428,997 | | 1/1984 | Shulman . |
| 4,589,687 | | 5/1986 | Hannon . |
| 4,617,194 | | 10/1986 | Scott et al. . |
| 4,704,310 | | 11/1987 | Tighe et al. . |
| 4,938,830 | | 7/1990 | Cannistra . |
| 5,250,133 | | 10/1993 | Kawamura et al. . |
| 5,364,735 | | 11/1994 | Akamatsu et al. . |
| 5,475,038 | | 12/1995 | Skoultchi . |
| 5,478,629 | | 12/1995 | Norman . |
| 5,492,589 | | 2/1996 | Mizuno . |
| 5,494,707 | | 2/1996 | Wang et al. . |
| 5,525,400 | | 6/1996 | Manser et al. . |
| 5,695,589 | | 12/1997 | German et al. . |
| 5,702,557 | | 12/1997 | Manser et al. . |
| 6,036,997 | * | 3/2000 | Ragland et al. . |

FOREIGN PATENT DOCUMENTS 0 659 579 A2 6/1995 (EP) .

* cited by examiner

*Primary Examiner*—Bernard Pianalto
(74) *Attorney, Agent, or Firm*—Merchant & Gould P.C.

(57) ABSTRACT

The invention provides a protective fihn which includes a base film, a release layer, a protective layer and an adhesive layer. The protective layer is formed using a curable composition. The invention is also directed towards methods of making the protective film of the invention. According to one embodiment of the invention, the protective film is made using a one-step curing process. In an alternate embodiment, the protective film of the invention is formed using a two-step curing process. The invention is also directed towards a method of making a protected data carrying device. According to the invention, the protected data carrying device includes a polymeric substrate and a protective coating. Optionally, the protected data caring device can include more than one layer of the protective coating. The invention is also directed towards a protected data carrying device which includes a polymeric substrate and the protective coating of the invention.

34 Claims, 1 Drawing Sheet

METHOD FOR MAKING PROTECTIVE FILM

FIELD OF THE INVENTION

The invention relates to a protective coating for a data carrying device, a protected data carrying device and methods for making the protective coating and protected data carrying device.

BACKGROUND OF THE INVENTION

Polymeric data carying devices are well-known and include identification cards, telephone calling cards, instant cash cards, credit cards, and company identification cards. Typically, polymeric data carrying devices include a polymeric substrate, on which information, such as a person's name, account number, address, or picture, is imprinted. After the polymeric substrate is customized, the card is typically protected with a clear protective overlay.

Typical protective overlays include a resin such as methyl methacrylate, ethyl methacrylate, vinyl chloride/vinyl acetates, cellulose acetate butyrates and other similar resins. The protective overlay may be applied to the polymeric substrate as a wet lacquer by dissolving the resin in a solvent or carrier. After the lacquer is applied to the substrate, the solvent or carrier is evaporated and the residual resin forms the protective overlay.

Alternately, the protective overlay can be applied to the polymeric substrate as a laminate. In this technique, the resin is first applied to a carrer such as polyester film. To evenly disperse the resin on the film, the protective resin is typically dissolved in a solvent or carrier solution and coated onto the film using a solution coating machine, such as a machine for gravure printing, mayer rod metering, reverse roll, slot die, curtain coating or screen printing. After the solution is applied to the film, the solvent or carrier solution is evaporated, typically by the application of heat. Similarly, a resinous heat sealable adhesive, such as butyl methacrylate or vinyl chloride/vinyl acetate polymers, is coated on top of the protective coating. The resultant protective laminate can then be laminated to the polymeric substrate with the application of heat and pressure. After lamination, the carrier film is stripped away, leaving a protective coating on the card surface which protects images thereon from abrasion, solvent or plasticiser attack.

Other protective laminates include clear films such as polyester, polypropylene, polyvinyl chloride, acetate, etc. that can be laminated to the surfaces of the card. According to this technique, a solution including a heat sealable adhesive is coated onto the clear film. The solvent is evaporated to leave an adhesive layer on the clear film. The film is then die cut to the desired dimensions and hot laminated to the card using a hot roller or hot platen.

Other known protective coatings for data carrying devices include ultraviolet radiation curable ("U.N. curable") compositions. U.V. curable compositions include monomers and/or oligomers that polymerize upon exposure to U.V. radiation. U.V. curable coatings are generally applied to a data carrying device as a flowable composition and subsequently cured to form a protective coating. U.V. cured protective coatings provide superior abrasion and chemical resistance as compared to other resinous protective coatings due to cross-linking of the monomers and/or oligomers in the coating induced by exposure to U.V. radiation.

However, there are disadvantages associated with U.V. curable compositions. The U.V. curable composition must be exposed to U.N. radiation, thus an end user risks exposure to U.V. radiation. Furthermore, the equipment necessary for curing a U.V. curable composition is both expensive and complex.

A protective coating for data carrying devices that has the superior physical properties of U.V. curable coatings without the disadvantages associated therewith is therefore desirable. It is filrther desirable to have a protective coating that can be applied to a data carrying device by an unskilled end user without significant exposure to hazardous chemicals or need for complex machinery.

SUMMARY OF THE INVENTION

The present invention is directed towards a protective coating having abrasion and chemical resistance of known curable coatings, but which is applied to a polymeric substrate, such as a data carrying device, using an adhesive. Unlike known polymeric laminates, the protective coating of the invention includes a protective layer made from a curable composition. However, instead of applying the curable composition directly to the data carrying device and then curing the curable composition, the curable composition is included in a protective film and cured and then adhered to the data carrying device using an adhesive. Thus, the protective coating of the invention is safe and easy for an end user to apply to a data carrying device. Furthermore, the protective coating of the invention can be applied to the data carrying device in multiple layers. The more layers that are applied, the more protection for the data carrying device. Preferably the curable coating is a U.V. curable coating and the adhesive is a heat sealable adhesive. Preferably the protective coating is applied using a conventional heat lamination process.

The protective film of the invention includes a base film, a protective layer and an adhesive layer. Preferably, the protective film also includes a release layer. Generally, the base film is a flexible sheet of polymers, such as polycarbonate, polyethylene naphthalate or polyester, that finctions as a substrate and carrier for the protective coating of the invention. If present, the release layer is adjacent to the base film. According to the invention, the release layer is a resinous composition that facilitates separation of the base film from the protective coating when the protective coating is applied to a polymeric substrate. Suitable resins for the release layer include acrylics, acrylates, methacrylates, polyesters, polyvinyl butyrals, cellulose acetate butyrates, cellulose acetate propionoates, polyvinyl acetates and polyvinyl chlorides. The protective layer is adjacent to the release layer, if present, and on the opposite side of the release layer from the base film. If no release layer is present, the protective layer is applied directly to the base film. The protective layer is formed by applying a curable composition to the release layer and curing the curable composition. The curable composition includes a polymerizable composition and a solvent, and preferably a polymerization initiator. Preferably, the polymerizable composition includes ethylenically unsaturated monomers and/or oligomers such as acrylates, diacrylates and triacrylates. Preferably, the polymerization initiator is activated by actinic radiation. Preferably the solvent is an organic solvent. Most preferably the curable composition is cured by exposure to ultraviolet (U.V.) radiation. The protective film of the invention also includes an adhesive layer that is adjacent to the protective layer, on side of the protective layer opposite the release layer and base film. Preferably, the adhesive layer includes a heat sealable adhesive. Preferably the adhesive layer includes resins such as acrylics, ethyl methacrylate, polyvinyl acetate, butyl methacrylate, methacrylate copolymers, polyester, copolyester and/or vinyl chloride/vinyl acetate copolymers.

The invention is also directed towards methods of making the protective film of the invention. According to one embodiment of the invention, the protective film is made using a one-step curing process. According to this embodiment, a release composition which includes a resinous component is applied to a base film (if a release layer is present in the protective coating). Preferably the release composition includes a solvent. If a solvent is included in the release composition, the solvent is evaporated from the release composition after application to the base film. The remaining resinous material forms the release layer. A curable composition is then applied to the release layer. if no release layer is present, the curable composition can be applied directly to the base film. The curable composition includes a polymerizable composition. Preferably, the curable composition also includes a solvent and a polymerization initiator. If present, the solvent in the curable composition is evaporated such that the polymerizable composition and polymerization initiator form a curable coating. The curable coating is then fullly cured to form the protective layer. Preferably, the curable coating is cured by exposure to ultraviolet radiation. An adhesive composition, is then applied to the protective layer. Preferably, the adhesive composition includes a solvent. If so, the solvent in the adhesive composition is evaporated and the remaining resin forms the adhesive layer.

In an alternate embodiment, the protective film of the invention is formed using a two-step curing process. As described in connection with the one-step curing process, a release composition is applied to a base film (if a release layer is desired) to form a release layer. A curable composition is then applied to the release layer (if present, if no release layer is present, the curable composition is applied directly to the base film) to form a curable coating. The curable coating is then partially cured, preferably by exposure to ultraviolet radiation. An adhesive composition is then applied to the partially cured curable coating to form an adhesive layer. Once the adhesive layer is formed, the curable coating is fully cured by exposure to ultraviolet radiation to complete formation of the protective layer.

The invention is also directed towards a method of making a protected data carrying device. According to the invention, the protected data carrying device includes a polymeric substrate and a protective coating. The protected data carying device is formed by positioning the protective film of the invention such that the adhesive layer is adjacent to the polymeric substrate. The protective coating is then adhered to the polymeric substrate. Preferably, the adhesive is a heat sealable adhesive. Preferably the protective film and polymeric substrate are exposed to a temperature of about 150° C. to about 220° C. and a pressure of about 400 psi to about 700 psi to laminate the protective film to the polymeric substrate. The base film is then removed from the protected data carrying device. Optionally, a second protective film is positioned such that the adhesive layer of the second film is adjacent to the release layer (or the protective layer, if no release layer is present) of the protective coating of the protected data carrying device. The second protective film is then laminated to the release layer (or the protective layer) of the first protective coating. Multiple layers of the protective coating can thus be applied to a polymeric substrate. The invention is also directed towards a protected data carrying device which includes a polymeric substrate and the protective coating of the invention.

DETAILED DESCRIPTION OF THE INVENTION

The invention is directed toward a protective film suitable for adhering to a polymeric substrate, methods of making the protective film, methods of adhering the protective film to a polymeric substrate, and a protected data carying device which includes a polymeric substrate and a protective coating.

The present invention provides a protective coating having superior abrasion and chemical resistance associated with cured coatings, but which is applied to a polymeric substrate using an adhesive. Instead of applying the curable composition directly to the polymeric substrate and then curing the curable composition, the curable composition is included in a protective film and cured prior to application to the polymeric substrate. According to the invention, the protective film is applied to the polymeric substrate using an adhesive. Thus, the protective coating of the invention is safe and easy for an end user to apply to a polymeric substrate. Furthermore, the protective coating of the invention can be applied to the polymeric substrate in multiple layers. The more layers that are applied, the more protection for the data carrying device.

Figure 1:
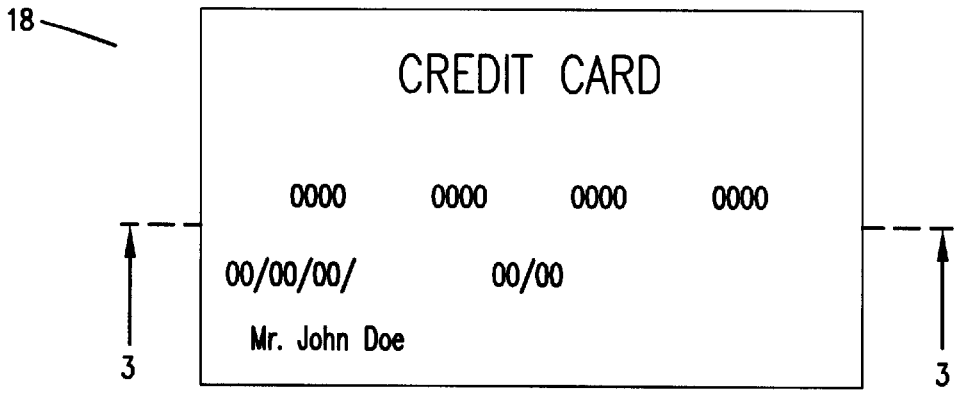
FIG. 1 is a plan view of a data carying device.
Figure 2:
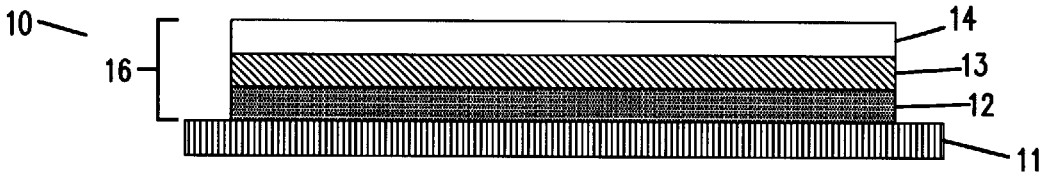
FIG. 2 is a cross section of the protective film of the invention.
Figure 3:
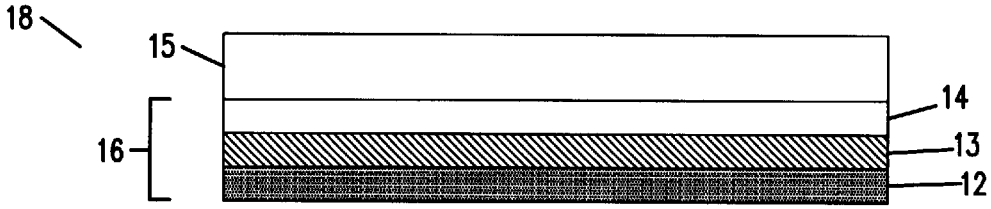
FIG. 3 is a cross section of the data carrying device of FIG. 1 which includes the protective coating of the invention.
Figure 4:
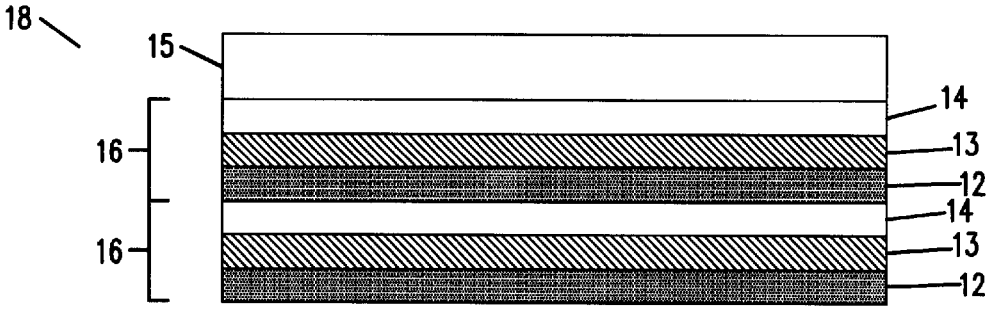
FIG. 4 is a cross section of the data carrying device of FIG. 1 which includes multiple layers of the protective coating of the invention.

The invention will now be described with reference to the Figures, in which like elements are numbered the same. FIG. 1 is a plan view of an exemplary data carrying device 18. FIG. 2 shows a cross section of a protective film 10 of the invention. FIG. 3 shows a cross section of a protected data carrying device 18, such as that shown in FIG. 1 taken at line 3—3. The protected data carrying device 18 shown in FIG. 3 incorporates the protective coating 16 of the invention. FIG. 4 also shows a cross section of a protected data carrying device 18, such as that shown in FIG. 1, taken at line 3—3. The protected data carrying device 18 in FIG. 4 incorporates more than one layer of the protective coating 16 of the invention.

I. The Protective Film

The invention provides a protective film 10 (FIG. 2) suitable for adhering to a polymeric substrate 15 to form a protected data carrying device 18 (FIGS. 1, 3 and 4). According to the invention, the protective film 10 includes a base film 11, a protective layer 13 and an adhesive layer 14. Preferably, the protective film 10 also includes a release layer 12. The protective coating 16 includes a protective layer 13 and an adhesive layer 14, and preferably a release layer 12.

Base Film

The base film 11 finctions as a substrate and carrier for the protective coating 16 of the invention. The base film 11 also protects the protective coating 16 during storage and shipping. The base film 11 can be made from any material to which the release layer 12 will moderately adhere. As used herein, "moderately" means that the release layer 12 adheres to the base film 11 sufficiently such that the protective film 10 can be manipulated (e.g., moved, inverted, rolled) without distorting or removing the protective coating 16 from the base film 1l. However, the release layer 12 must also be capable of releasing from the base film 11. In particular, the base film 11 should be capable of being removed from the protective covering 16 after it is adhered to a polymeric substrate 15. Preferably, the base filn 11 is capable of withstanding the heat and pressure applied to the protective 10 during lamination without distorting.

Exemplary materials for the base film 10 include, but are not limited to, polyester, polyamide, polycarbonate, polyethylene napthenate, polypropylene, polyethylene laminated to polyester, or mixtures and combinations thereof. These materials are preferred, particularly when the protective coating 16 is applied using a heat lamination process because these materials display resistance to the heat and pressure to which the base film 10 is exposed during lamination. Furthermore, such films are widely available and are easy to process. Polyester film is preferred because it displays satisfactory adhesion and release properties and is relatively inexpensive. Other suitable films include coated films, such as silicone release films. These films are particularly suitable when a release layer 12 is not included in the protective film 10.

The base film 11 should be thin enough to provide flexibility and optimal heat transfer during lamination. However, if the film is too thin, the film tends to be difficult to handle and results in an increase in scrap rates. Furthermore, thin films are more likely to break during lamination, causing frustration for the user. Thus, the base film 11 should be sufficiently thick to provide ease of coating and processing. Furthermore, the base film 11 should be sufficiently thick to provide the base film 11 with strength and integrity, both during storage and handling, and particularly when the base film 11 is stripped from the protective coating 16 after the protective coating 16 is laminated to a polymeric substrate 15. However, thick films require the application of more heat during lamination for the successful transfer of the protective coating 16 to the polymeric substrate 15. Thick films also require more materials. Thus, excessively thick films add unnecessarily to the cost of the product.

The thickness of the base film 11 can vary considerably and still function adequately. Generally, a base film having a thickness from about 3 $\mu$m to about 50 $\mu$m is suitable. A base film having a thickness from about 10 $\mu$m to about 20 $\mu$m is more preferred. A base film having a thickness from about 11 $\mu$m to about 13 $\mu$m is most preferred as having maximal performance and handling properties.

Release Layer

The release layer 12 facilitates separation of the base film 11 from the protective coating 16 after the protective coating 16 is applied to a polymeric substrate 15. Although not necessary, a release layer 12 is preferably included in the protective coating 16. According to the invention, the release layer 12 includes a resinous material. To prevent excessive bonding of the release layer 12 with the base film 11 when protective film 10 is subsequently exposed to U.V. radiation, the resinous material is preferably not affected when exposed to U.V. radiation. Preferably, the release layer 12 adheres well to both the curable coating 13 and the adhesive layer 14, such that the protective coating 16 can be applied to the polymeric substrate in multiple layers (FIG. 4). The release layer 12 preferably maintains its integrity and physical characteristics during curing, lamination and storage.

The resinous material of the release layer 12 preferably has low elongation and tensile strength properties, such that the resinous material will break cleanly when the base film 11 is removed from the protective coating, for example, after lamination to a polymeric substrate 15. If not, the protective coating 16, or portions thereof, might be removed along with the base film 11, or portions of the base film 11 may remain adhered to the protective coating. Furthermore, if the release layer 12 does not break cleanly, a ragged edge may remain around the data carrying device 18 upon removal of the base film 11. The ragged material can flake off and the flakes may interfere with further processing and functions of the protected data carrying device 18. Therefore, resins with a tensile strength of less than about 30,000 psi, more preferably less than 15,000 psi and elongations less than about 30%, more preferably less than about 15% are desirable.

Generally, for end user satisfaction, particularly in hot climates, the release layer 12 should have a glass transition temperature (Tg) that is sufficiently high to prevent the surface of the protected data carrying device 18 from becoming tacky or gooey at temperatures of up to 150° F. (65° C.). It is also preferable that the release layer 12 have a sufficiently high Tg so the release layer 12 does not become tacky when exposed to heat during lamination (e.g., at a temperature range from about 150° C. to about 220° C.). Preferably, the Tg for the release layer 12 is at least about 150° F. (65° C.), more preferably at least about 212° F. (100° C.).

Alternately, a wax or similar substance can be added to the release layer 12 to prevent the release layer 12 from adhering to the base film 11 during lamination, even if the resin softens and becomes tacky. A wax like substance can also be added to the release resin to modify properties such as tensile strength and elongation so that resins with high values for tensile strength and elongation can be used. Exemplary wax like substances include polymeric wax, such as polyethylene, polyolefins, polytetrafluoroethylene (PTFE); and natural waxes such as montan wax, beeswax, camauba and paraffin wax. Suitable resins for use in the release layer 12 include acrylics, acrylates, methacrylates, polyesters, polyvinyl butyrals, cellulose acetate butyrates, cellulose acetate propionoates, polyvinyl acetates, or polyvinyl chlorides. A mixture of methyl methacrylate (Elvacite 2051 from ICI Americas) and a polymeric wax (SL 528 from Daniel Products) is preferred because it adheres strongly to both the base film 1I and the adhesive layer 14.

Other additives that may be included in the release layer 12 include ultraviolet light absorbers. Ultraviolet light absorber additives improve the stability of printed graphics and characters on the data carying device, for example, when the data carrying device is exposed ultraviolet radiation, such as from sunlight. Examples of ultraviolet light absorbers include Tinuvin 328 and Tinuvin 292 (Ciba-Geigy Corporation). Preferably, the addition of these additives to the release layer 12 will not affect the physical properties of the protective coating 16 such as tensile strength or increase adhesion of the release layer 12 to the base film 11 or reduce adhesion to of the release layer 12 to the adhesive layer 14 of a subsequent protective coating 16.

The release layer 12 is generally as thin as possible to minimize the total thickness of the protective coating 16 that is applied to the polymeric substrate 15. However, a release layer 12 that is too thin will provide poor release of the protective coating 16 from the base film 11. A release layer 12 that is too thick may result in a protective film 10 in which the base film 11 prematurely releases from the protective coating 16. Furthermore, a release layer 12 that is excessively thick may have too much integrity and thus, may not break cleanly when the base film 11 is removed.

Typically, the release layer 12 is about 0.05 μm to about 5.0 μm, more preferably about 0.1 μm to about 2.0 μm thick.

Protective Layer

The protective layer 13 protects and extends the useful life of a frequently handled data carrying device 18 by providing the data carrying device 18 with superior abrasion and chemical resistance. Cross-linking of the monomers and/or oligomers in the curable composition results in a protective coating 16 having superior abrasion, plasticiser and/or solvent resistance when compared to conventional protective laminates. In contrast to the protective coating 16 of the invention, conventional protective laminates contain thermoplastic resinous constituents which are not cross-linked, such as methyl and ethyl methacrylates and/or vinyl chloride/vinyl acetate copolymers. Although conventional protective laminates provide some abrasion and chemical resistance, the coatings are not as resistant as the cross-linked protective coating 16 of the invention.

The protective layer 13 is formed by applying a curable composition to the release layer 12 (or the base film 11, if release layer 12 is not present) and curing, for example, by exposing the curable composition to ultraviolet radiation. The curable composition includes a polymerizable composition. Typically, the curable composition also includes a polymerization initiator and a solvent. Optionally, the curable composition includes additives such as a polymeric binder.

The thickness of the protective layer 13 is important. If the protective layer 13 is too thick, it may not release cleanly fiom the base film 11 or alternately, portions of the base film 11 may remain adhered to the protective coating causing the base film 11 to rip. Preferably, the protective layer 13 can be embossed (for example, with a name and/or account nunber) without cracking. If the protective layer 13 is too thick it will tend to crack and split. This can result in poor print quality and increase the susceptibility of the protected data carrying device 18 to chemical attack. If the protective layer 13 is too thin, it may not provide appropriate chemical and/or abrasion resistance. Typically, the protective layer 13 is about 0.5 μm to about 25 μm thick, more preferably about 1.5 μm to about 12 μm thick, most preferably about 2.0 μm to about 3.0 μm thick.

Unless otherwise noted, the amount of each component included in the curable composition (discussed below) is shown as percentages by dry weight (i.e. without solvent) of the composition. Thus, the percentages reflect the percentage by weight of each ingredient in the curable composition either before solvent is added to or after solvent is evaporated from the composition.

Polymerizable Composition

The polymerizable composition includes low molecular weight (i.e., less than about 5,000 Da) reactive monomers and/or oligomers which can be cured to form a three-dimensional matrix of cross-linked polymers. As used herein, a "reactive" monomer and/or oligomer is any monomer and/or oligomer that is capable of polymerizing and/or cross-linking under controlled conditions. Monomers and/or oligomers useful in the invention typically polymerize (i.e., cure) upon creation of a free radical in the composition. Preferably, the free radical is created by a polymerization initiator, which is activated by a source of heat or radiation.

Preferred reactive monomers and/or oligomers include ethylenically unsaturated monomers and/or oligomers such as acrylates, diacrylates and triacrylates. Examples of suitable reactive monomers and/or oligomers include: trimethylolpropane triacrylate (TMPTA), ethoxylated trimethylolpropane triacrylate (ethoxylated TWTA), and the monomers and oligomers disclosed on page 5 at lines 54–58 and on page 6 at lines 1–23 in European Patent Application 0677397 A1, published Oct. 18, 1995, the disclosure of which is hereby incorporated by reference.

Diacrylates and triacrylates are preferred because they cure to form a cross-linked protective layer 13 that has good physical and mechanical properties, such as good abrasion and chemical resistance, but yet transfers crisply from the base film 11 to the polymeric substrate 15. Diacrylates and triacrylates provide an optimum cross-link density due to their functionality. Diacrylates and triacrylates also provide an optimum inter polymer chain length due to their molecular weight. As the cross-link density is reduced, for example, by increasing the chain length and/or increasing the molecular weight of the monomers, the resulting protective layer 13 has increased tensile strength and is capable of longer elongation before breaking. Furthermore, as the cross-linking density is reduced and the chain length increased, the resulting protective layer 13 may be tacky (i.e., gooey or gummy). This could interfere with processing of the protective film 10 because the coated side of the film would stick to the backside of the film when wound into a roll. However, increased tensile strength and longer elongation capabilities may interfere with the transfer of the protective coating 16 to the polymeric substrate 15. Higher cross-link density and shorter polymer chain lengths result in a protective layer 13 that is more brittle and hence provides less chemical and abrasion resistance.

Cross-link density of the protective coating 13 can also be increased by including higher functional monomers, such as trifunctional or tetrafinctional monomers, in the polymerizable composition. Examples of higher finctional monomers include triacrylates and tetraacrylates. Including higher functional monomers in the polymerizable composition increases the cross-link density of the resulting protective coating, as long as the molecular weights of the monomers are not substantially increased. As the molecular weights of the monomers increase, the cross-link density decreases. For example, addition of large organic groups to the monomers increases their molecular weight and decreases the resulting cross-link density. Likewise, the cross-link density can be lowered by using monofunctional and difimctional monomers such as allyl methacrylate or ethylene glycol. TMPTA and ethoxylated TMPTA are most preferred because they provide maximal abrasion resistance, plasticiser resistance, intercoat adhesion, embossability and edgeline transfer (non flaking).

Included within the scope of the invention are other monomers and/or oligomers that are cured, for example, by ultraviolet curing, cationic curing, or electron beam curing. Although U.V. curing is preferred, other curing methods may provide a protective layer 13 having similar performance properties as the U.V. cured protective layer 13. Generally, electron beam cured coatings tend to achieve higher degrees of cure than U.V. cured coatings, because the number of initiation sites does not depend upon an additive dissolved in the coating, but on the number of collisions of high energy electrons with the components of the formulation. For example, acrylate and methacrylate monomers and/or oligomers cross-link with each other upon exposure to UN. radiation with the aid of a photoinitiator.

ACRYLATE

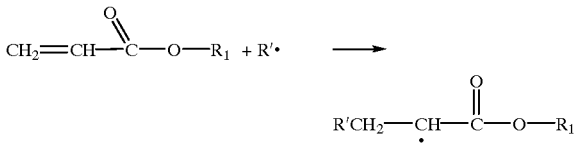

METHACRYLATE

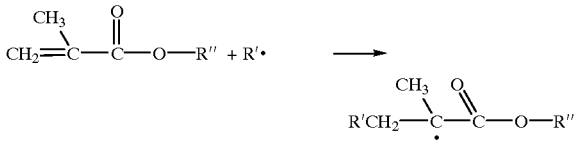

The amount of monomer and/or oligomer (i.e. polymerizable composition) included in the curable composition can vary depending on the desired balance of chemical and abrasion resistance with embossability, crisp transferability of the coating and intercoat adhesion. If the curable composition includes too much polymerizable composition, the protective coating 16 may lose its intercoat adhesion. Furthermore, the protective coating 16 may have too much integrity to break cleanly from the film carrier 11 and transfer to the card. If the curable composition includes too little polymerizable composition, the protective coating 16 may lose chemical and abrasion resistance which may result in less durability and a shorter useful life for the protected data carrying device 18. Typically, the curable composition includes about 30 wt % to about 100 wt %, preferably about 55 wt % to about 65 wt % polymerizable composition.

Cross-linking of the monomers and/or oligomers in the curable composition result in a protective coating 16 having superior abrasion, plasticiser and/or solvent resistance when compared to conventional protective laminates. Superior abrasion resistance means that the protective coating 16 of the invention provides about 10% or greater, more preferably about 15% to about 20% greater abrasion resistance as compared to a conventional laminate. For example, a polymeric substrate protected with one layer of conventional protective laminate can typically sustain only about 150 to about 200 cycles on an abraser before the image underneath the protective coating is exposed. In contrast, a card protected with one layer of the protective coating 16 of the invention (which includes a U.V. cured protective layer 13) sustains about 200 to about 250 cycles before the underlying image is exposed, as measured using a 5150 Abraser (Taber industries) with CS10 wheels and 500 grams additional weight.

Superior solvent resistance means that the protective coating 16 of the invention provides from about 2 times to about 3 times, more preferably about 5 times to about 10 times the solvent resistance as conventional polymeric laminates. For example, data (i.e., lettering, photographs, designs) imprinted on a polymeric substrate that is overlaid with the protective coating 16 of the invention is unaffected by about 100 double rubs of a felt tipped pen filled with methyl ethyl ketone whereas, data underneath a conventional protective laminate (e.g., a non-cross-linked coating) degrades after about only 10 double rubs.

Solvents

According to the invention, the curable composition preferably includes a solvent to facilitate application of the polymerizable composition to the base film 11. After the curable composition is applied to the base film 11, the solvent is allowed to evaporate and the remaining constituents form a curable layer 13. Suitable solvents include those in which the polymerizable composition and other additives of the curable composition dissolve or remain in solution However, the solvent should not completely dissolve the release layer 12 or base film 11 to which the curable composition is applied. Some solvent attack is actually preferred as it may improve intercoat adhesion of the curable coating 13 to the release layer 12. Preferably the solvent is capable of dissolving the polymerizable composition and capable of evaporating in a reasonable time and within a desired temperature range. Although the solvent may evaporate under ambient conditions (e.g., about 15° C. to about 25° C.), it is preferable to evaporate the solvent at an elevated temperature to reduce the amount of time necessary for the evaporation to be completed. Preferably, the solvent evaporates in about 1 second to about 10 seconds at temperature between about 50° C. and about 200° C., more preferably about 2 seconds to about 5 seconds at a temperature range of about 60° C. to about 150° C., most preferably about 3 seconds to about 4 seconds at a temperature range of about 80° C. to about 100° C. Furthermore, the solvent should have a surface tension low enough to evenly coat the release layer 12.

Although water based compositions or solventless compositions can be used, organic solvents are preferred. For example, many oxygenated, aromatic, chlorinated or ester solvents are suitable for use in the curable composition. Preferably, the solvent is an organic solvent such as an amide, ether, ketone, chlorohydrocarbon, ester, nitrile, and/or mixtures thereof. Exemplary solvents include methyl ethyl ketone, acetone, dimethyl formamide, methylene chloride, ethyl acetate, toluene, tetrahydrofuran, acetonitrile, nitromethane, and nitroethane. Methyl ethyl ketone is the most preferred solvent because it readily dissolves the polymerizable composition and is readily available, dries easily, and has a lower toxicity than some of the other solvents.

The amount of solvent in the curable composition may affect the viscosity of the composition and the amount of time required for the curable composition to "dry" once applied to the release layer 12. The solvent selected may also determine the amount of solvent required to maintain the desired viscosity for the curable composition. Furthermore, the amount of solvent combined with the polymerizable composition can vary depending on the method by which the curable composition is to be applied to the release layer 12. The amount of solvent may also affect the final dry coating thickness of the deposited curable composition. For example, increasing the amount of solvent will tend to decrease the dry coating thickness. Likewise, decreasing the amount of solvent will tend to increase the coating thickness (when the coating method and metering items are kept the same). Furthermore, the amount of solvent can vary depending on the monomers, oligomers, other resins and additives present in the curable composition and the proportions thereof. Additionally, more or less solvent may be used depending on the coating method (e.g., direct gravure, reverse gravure, mayer rod, knife over roll, screen printing and slot die), metering application size, coating speed and dry time. Preferably, the curable composition is maintained at a viscosity so that it forms an even coat when applied to the release layer 12.

Generally, the curable composition includes about 30 wt % to about 95 wt %, more preferably about 75 wt % to about 85 wt % solvent. For example, when applied using gravure printing, the curable composition preferably contains about 30 wt % to about 95 wt % solvent. However, when the curable composition is applied by reverse gravure (with a 90 trihelical gravure cylinder at 75 fpm), the curable composition preferably includes about 60 wt % (wet) solvent to about 90 wt % (wet) solvent.

Polymerization Initiator

Preferably, the curable composition also includes a polymerization initiator that is activated under controlled conditions. As used herein, a "polymerization initiator" is a substance that initiates polymerization and/or cross-linking of the polymerizable composition. Preferably the polymerization initiator is activated by actinic radiation. However, polymerization initiators can be actuated by other sources, such as heat or visible light.

Preferably, the polymerization initiator is activated by ultraviolet radiation. Generally, U.V. radiation is that spectrum of wavelengths from about 180 nm to about 460 nm and is usually obtained from the discharge of a mercury vapor or xenon lamp. One tppe of photoinitiator undergoes cleavage to form a free radical upon exposure to ultraviolet radiation. The free radical is then capable of initiating polymerization and/or cross-linking of the monomers and/or oligomers present in the polymerizable composition. In the cross-linking reactions, a chain reaction can be set off by the absorption of one photon by the photoinitiator. Alternately, one photon can result in the formation of one cross-link. As the monomers and/or oligomers become cross-linked, the molecular weight of the resulting polymers increases. Thus, the curable composition begins to resemble a solid. When the reaction stops, any unreacted groups remain isolated.

The amount of photoinitiator included in the composition depends on a multitude of factors including type of photoinitiator selected, U.V. curing system employed (e.g., metal halide/mercury vapor/etc.), selection of U.V. energy emitted (e.g., 200 watts/300 Watts/etc.), coating line speed and dried curable composition thickness. If there is too little initiator included in the composition, the polymerizable composition will be undercured, and the physical properties and/or usefull life of the curable coating could be reduced. For example, the protective layer 13 may not harden sufficiently to become tack-free. This could result in the protective coating 16 blocking to the backside of the base film 11 when wound in a roll, rendering the product unserviceable. Adding excess initiator is not cost efficient Moreover, excess initiator may precipitate out of solution. Typically, 1 wt % to about 8 wt % of the curable composition is photoinitiator, preferably about 2 wt % to about 6 wt %, most preferably, 3 wt % to 4 wt %.

Initiators useful in the invention include polynuclear quinones, which are compounds having two intracyclic carbon atoms in a conjugated carbocyclic ring system. Other suitable initiators include the initiators disclosed in U.S. Pat. No. 5,279,689 to Shvartsman at columns 5 and 6, the disclosure of which is hereby incorporated by reference. Additionally, the curable composition may include derivatives and combinations of the following initiators: 1-hydroxycyclohexyl phenyl ketone (HCPK), alpha-amino acetophenone, benzophenone, 2, 2-dimethoxy-2-phenyl acetophenone, 2-methyl-1-[4-(methyl-thio)phenyl]-2-morpholino propan-1-one (MMMP), and 2-hydroxy-2-methyl-1-phenyl-propan-1-one (HMPP). HCPK is a most preferred initiator, and it is commercially available as frgacure 184 from Ciba-Geigy Corp.

1-hydroxycyclohexyl phenyl ketone (HCPK) initiates via an alpha-cleavage process (Norrish Type 1).

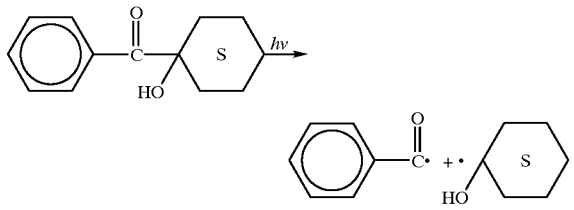

Additives

Other additives that can be included in the curable composition include polymeric binders, colorants, thickeners, dyes, pigments, adhesion promoters, wetting agents, dispersing agents, defoamers, slip additives, adhesion resistant additives, fillers, leveling agents, antioxidants, optical brighteners, U.V. stabilizers, flatting agents, waxes, reactive diluents, and thermal stabilizers. Preferred additives are able to maintain their structural stability and effectiveness throughout and subsequent to curing and lamination.

Preferably the curable composition includes a polymeric binder to promote adhesion between the protective layer 13 and the release layer 12, as well as between the protective layer 13 and the adhesive layer 14. Preferably, the polymeric binder also facilitates cleavage of the protective coating 16 from the base film 11 after lamination to a polymeric substrate 15. This is accomplished by maintaining appropriate tensile and elongation properties.

Any polymeric binder useful in a laminate that does not interfere with or inhibit polymerization of the monomer and/or oligomer and is capable of maintaining its structural integrity under temperatures and pressures associated with lamination can be used. Suitable polymeric binders include: methyl methaciylate polymer, polyvinyl acetate polymer, and binders disclosed in column 6 at lines 10–59 in U.S. Pat. No. 5,279,689, which issued on Jan. 18, 1994 to Shvartsman, the disclosure of which is incorporated herein by reference. Methyl methacrylate, polyvinyl acetate, and mixtures thereof are the most preferred polymeric binders. These polymeric binders are commercially available as Elvacite 2051 (ICI Resins) and as Vinac B-15 (Air Products Chemical Company), respectively.

The amount of polymeric binder included in the curable composition can vary with the end use of the product. However, if too little polymeric binder is included in the composition, adhesion may be compromised. If too much polymeric binder is included in the composition, physical properties and/or performance of the curable composition may be decreased. Typically, the curable composition includes about 10 wt % to about 90 wt % polymeric binder, more preferably about 25 wt % to about 35 wt %.

Adhesive Layer

The function of the adhesive layer 14 is to adhere the protective coating 16 of the invention to a polymeric substrate 15. In an alternate embodiment, wherein multiple protective coatings 16 are applied to a polymeric substrate 15 (FIG. 4), it is also preferable that the adhesive layer 14 adhere to the release layer 12.

While the use of other adhesives is included within the scope of the invention, preferably the adhesive layer 14 is a heat sealable adhesive which bonds the protective coating 16 to the polymeric substrate 15 during conventional lamination processes (e.g., at a temperature of about 150° C. to about 220° C. and pressure of about 400 psi to about 800 psi, more preferably a temperature of about 170° C. to about 190° C. and pressure of about 500 psi to about 700 psi).

According to the invention, the adhesive layer 14 comprises a resinous material. Preferably, the resinous material has a suitable Tg such that the protective coating 16 does not block when it is wound onto itself during storage. Resins with a Tg of at least about 45° C. are preferred, more preferred are resins with a Tg of at least about 50° C. Furthermore, resins with a Tg below about 150° C. are also desirable so that the protective coating 16 can transfer to the polymeric substrate 15 during conventional lamination processes. More preferably, the resin has a Tg below about 100° C. Most preferably, the resin has a Tg lower than the resins included in the protective layer 13. Preferably the resin has a tensile strength below about 20,000 psi and a elongation below about 30%, more preferably about a tensile strength below about 10,000 psi and an elongation below about 20% to insure that the protective covering 16 breaks cleanly from the base film 11 after lamination.

Examples of suitable resins include acrylics, butyl methacrylate, ethyl methacrylate, methacrylate copolymers, polyvinyl acetate and vinyl acetate/vinyl chloride copolymers. According to the invention, the adhesive layer 14 includes resins such as vinyl chloride/vinyl acetate copolymers, ethyl methacrylate polymers, butyl methacrylate polymers and their copolymers. Polyvinyl acetates, polyester and other acrylic resins may also be used as adhesives. Preferably the resin is a vinyl chloride/vinyl acetate (VCIVA) copolymer or an ethyl methacrylate (EM) (e.g., Elvacite 2042), butyl methacrylates and methyl methacrylates and copolymers thereof. Polyester adhesives such as Petaflex 30-9103 (available from National Starch and Chemical Company) or polyvinyl acetates such as VINAC B-15 (available from Air Products and Chemicals, Inc.) can also be used. A preferred polymer for the adhesive layer 14 is a vinyl chloride/vinyl acetate copolymer (UCAR VYLF; available from Union Carbide Corporation) because it has desired cleavage properties after lamination and a desirable adhesion to both the polymeric substrate 15 and the release layer 12.

The thickness of the adhesive layer is an important parameter. Generally, the adhesive layer should be thick enough to strongly adhere the protective layer 13 to the polymeric substrate. However, the adhesive layer should not be so thick that the base film 11 will not break cleanly when removed. Furthermore, a thicker adhesive layer will require additional heat for lamination. Preferably, the adhesive layer is about 0.2 $\mu$m to about 2.0 $\mu$m thick, more preferably about 0.7 $\mu$m to about 1.5 $\mu$m thick.

According to the invention, the adhesive layer 14 bonds strongly to both the protective layer 13 and the polymeric substrate 15. Cross-hatch tape testing can be used to determine how strongly the protective coating 16 is bonded to the polymeric substrate 15 and how strongly the layers of the protective coating 16 adhere to one another (intercoat adhesion). To perform cross-hatch tape testing, the surface of the protective coating 16 is scribed with a series of crosses using a cross hatch tool (e.g., eleven teeth; 1 mm spacing) after the protective coating 16 is applied to the polymeric substrate 15 by heat lamination. Scotch tape (e.g.,#810) is then applied over the cross hatch area (at a 45 degree angle from the cross hatches). The tape is firmly burnished with the head of a pencil eraser for approximately 15 seconds. The burnished substrate is then allowed to sit undisturbed for 30–90 seconds. Then the tape is jerked off the substrate (as quickly as possible), typically by pulling the tape at about a 120 degree angle. Observation of the card under a 5OX microscope (polarizing filters may be necessary) reveal whether any of the protective coating is missing. A strong bond is demonstrated when less than about 10%, more preferably less than about 5% of the cross hatch area is missing.

II. Methods of Making the Protective Film

The protective film 10 of the invention can be made using either a one step curing process or a two step curing process.

A. One Step Curing Process

According to a first embodiment, the protective film 10 of the invention is made using a one step curing process. According to this embodiment, a release composition is coated onto a base film 11 as a solution using conventional coating methods (if a release layer 12 is desired). The release composition is allowed to dry and form a release layer 12 on the base film 11. Typically, the release composition "dries" by allowing solvent in the release composition to evaporate. After the release layer 12 is formed, a curable composition is applied on top of the release layer 12 using known coating methods. If no release layer 12 is present, the curable composition can be applied directly to the base film 11. The curable composition is then allowed to dry and form a curable coating 13. Typically, this occurs by allowing solvent in the curable composition to evaporate. The dried curable coating 13 is then filly cured to form a protective layer 13. In a preferred embodiment, the curable coating 13 is cured by exposure to ultraviolet (U.V.) radiation. An adhesive composition, such as a heat sealable adhesive, is then applied on top of the protective layer 13. Solvent in the adhesive composition is allowed to evaporate such that an adhesive layer 14 is formed.

Release Layer

According to this embodiment, a release layer 12 is formed by applying a release composition to a base film 11. Although not necessary, it is preferably that the release composition include a solvent, in addition to the resinous material discussed above. Suitable methods for applying the release composition to the base film 11 include gravure printing, mayer rod metering, reverse roll, slot die, curtain coating or screen printing. Gravure, mayer rod and screen printing methods are preferred due to their ability to more accurately control coating weights as well as the ease of adjusting coating thickness, for example, by changing cell size, mayer rod size or screen size. Preferably, the release composition is applied to the base film 11 by gravure printing.

After the release composition is applied to the base film 11, the solvent is allowed to evaporate such that the remaining resinous material forms the release layer 12. The solvent is evaporated under ambient conditions or by exposing the composition to heat (e.g., from a forced-air dryer). Although increased temperature reduces the time required to evaporate the solvent, higher temperatures are more likely to deform or distort the base film. On the other hand, at lower temperatures, the composition requires more time to dry and the composition is more likely to dry incompletely.

The solvent should be capable of dissolving the resinous material and suspending any wax component of the release composition. The solvent should also have a surface tension low enough to evenly coat a non-print treated polyester film. Although water-based compositions or solventless formulations can be used, preferred solvents or organic solvents. Examples of suitable solvents include toluene, ethyl acetate, methyl isobutyl ketone, cellosolve acetate, methylene chloride, tetrahydrofuran, acetone, nitromethane, nitroethane, etc. Preferred solvents include toluene, methyl ethyl ketone and ethyl acetate. Methyl ethyl ketone is the most preferred solvent because it meets toxicity, flammability, solubility and drying characteristic requirements. Preferably, the solvent evaporates in about 1 to about 10 seconds at a temperature from about 50° C. to about 200° C., more preferably about 2 to 5 seconds at a temperature from about 70° C. to about 150° C., more preferably about 80° C. to about 120° C.

The relative amounts of resin and solvent in the release composition can vary, depending on the desired viscosity of the release composition and the desired drying time (i.e., the amount of time required for the solvent to evaporate from the release composition). Preferably, the release composition has a viscosity that is low enough such that the composition is capable of flowing and becoming evenly distributed upon application to the base film 11. However, energy and time are wasted evaporating excessive solvent. Furthermore, excess solvent can reduce the thickness of the dry release layer. The desired viscosity can also vary depending on the method by which the release composition is applied to the base film 11. For example, when the release composition is applied by gravure printing a preferred viscosity is about 10 centipoise to about 500 centipoise, more preferably about 50 centipoise to about 150 centipoise. In contrast, when the release composition is applied by screen printing a preferred viscosity is about 500 to about 5000 centipoise, more preferably about 1000 centipoise to about 3000 centipoise.

Typically, the release composition includes about 5 wt % (wet) to about 30 wt % (wet) resin, more preferably about 10 wt % (wet) to about 20 wt % (wet) resin. Most preferably, the release composition includes about 10 wt % (wet) to about 15 wt % (wet) resin and about 85 wt % (wet) to about 90 wt % (wet) solvent. For example, a 12% solids solution of the release composition applies a dry coating approximately 2.3 $\mu$m thick (or a dry coat weight of approximately 2.3 grams per square meter) when applied with a 90 trihelical cylinder.

Protective Laver

After the release layer 12 is formed, a curable composition is applied on top of the release layer 12. Preferably, the curable composition includes a polymerizable composition and a solvent, although a solvent is not necessary. Preferably, the curable composition also includes a polymerization initiator. Suitable constituents for each are discussed above.

According to the invention, the curable composition is applied to the release layer 12 as a solution using known coating methods such gravure printing, mayer rod metering, reverse roll, slot die, curtain coating or screen printing. The gravure, mayer rod and screen printing methods are preferred because it is easy to control coating weights as well as to adjust coating thickness by changing cell size, mayer rod size or screen size. More preferably, the curable composition is applied to the release coated film by gravure printing.

The relative amounts of resin and solvent in the curable composition can vary, depending on the desired viscosity of the curable composition and the desired drying time (i.e., the amount of time required for the solvent to evaporate from the curable composition). Although the viscosity should be low enough such that the curable composition evenly coats the release layer 12, the viscosity of the curable composition should not be so low that excessive solvent is used. Energy and time are wasted drying excess solvent. The relative amounts of resin and solvent in the curable composition can also vary depending the method by which the curable composition is applied to the release coated film. For example, when the curable composition is applied by gravure printing the preferred viscosity is about 10 centipoise to about 300 centipoise, more preferably about 50 centipoise to about 150 centipoise. In contrast, when the curable composition is applied by screen printing the preferred viscosity is about 500 centipoise to about 5000 centipoise, more preferably about 1000 centipoise to about 3000 centipoise.

The relative amounts of resin and solvent can also vary depending on the desired thickness of the dry coating. Generally, a solution having a higher solids content will form a thicker coating than a solution having a lower solids content (when all other parameters remain the same). The curable composition generally includes about 5% wet weight to about 40% wet weight resin, more preferably about 15% wet weight to about 30% wet weight resin, most preferably about 20% wet weight resin and 80% wet weight solvent. For example, a 20% solids solution of the curable composition applies a dry coat of approximately 2.8 grams per square meter (approximately 2.8 microns thick) when applied with a 90 trihelical cylinder.

After the curable composition is applied to the release layer, the solvent in the curable composition is evaporated. The solvent can be evaporated under ambient conditions or by exposing the composition to heat (e.g., from a forced-air dryer). Although the solvent will evaporate more quickly at a higher temperature, the base film 11 is more likely to deform or distort at high temperatures. However, at lower temperatures, the composition is likely to be incompletely dried and will take more time to dry. Preferably, the solvent evaporates in about 1 second to about 10 seconds at temperature between about 50° C. and about 200° C., preferably about 2 seconds to about 5 seconds at a temperature between about 70° to about 150° C., more preferably in about 3 seconds to about 4 seconds at a temperature between about 80° C. to about 120° C.

After the solvent is evaporated, the remaining constituents (e.g., the polymerizable composition and polymerizable initiator) form a curable coating 13. According to this embodiment, the curable coating 13 is then "fully cured" to form a protective layer 13. As used herein "cure" refers to a process by which a polymerizable composition (e.g., monomers and/or oligomers) present in the curable composition become cross-linked. In a "fully cured" composition, up to 20% of the acrylate functionality can remain unreacted. Essentially, in a fully cured composition, the majority of potentially reactive sites of the reactive monomer and/or oligomer (e.g., acrylate functionality) have reacted in the polymerization. For example, the majority of C=C bonds of acrylate monomers or oligomers have been changed to free radicals and cross-linked with another reactive site in a fuilly cured composition. Over curing either coating with UV radiation may cause the release coating 12 to bond to the base film 11 and may interfere with other properties of the protective coating 16 such as increased tensile properties which would prevent the coating from breaking from the film 11.

Preferably, the curable coating 13 is cured by exposure to U.V. radiation. Preferably, the curable coating 13 is subjected to U.V. radiation immediately after the solvent is evaporated, preferably before the protective film 10 is wound into a roll, typically within about 0 seconds to about 5 seconds. The U.V. radiation activates the polymerization initiator which initiates polymerization and/or cross-linking of the monomers and/or oligomers of the polymerizable composition. Curing can be performed using a mercury vapor curing lamp set at about 200 watts per lineal inch to about 400 watts per lineal inch. Alternatively, metal halide and/or xenon lamps can be used to initiate curing. For example, Irgacure 500 absorbance peaks are at 208 nm, 242 nm, and 326 nm and thus is well suited for use with mercury halide lamps which have emission peaks at 265 nm, 303 nm, 313 nm and 365 nm.

Web speed is the speed at which the film travels through the curing unit which essentially determines the time of exposure. Preferably the web speed is about 60 fpm to about 200 fpm.

The required dosage for curing the curable coating 13 is dependent on many factors, including the type of U.V. reflectors used, the use of IR filters, the amount and types of photoiniators used, coated film temperature, lamp manufacturer, the thickness of the curable coating 13, as well as the type of lamps and U.V. curing unit used. For example, the light band width shining on the web will vary depending on the manufacturer of the curing unit, as will the distance from the lamp to the web and the reflectors used. Generally, the curable composition is fully cured by exposing the protective film 10 to about 1000 mj/cm$^2$ to about 4500 mj/cm$^2$ of energy, more preferably about 1300 mj/cm$^2$ to about 2500 mj/cm$^2$. For example, the curable coating 13 can be cured by exposure to about 1300 mj/cm$^2$ to about 1700 mj/cm$^2$ of energy with a mercury halide lamp (Prime U.V. curing unit). In contrast, a metal Halide lamp (Eye Ultraviolet curing unit) may require about 1800 mj/cm$^2$ to about 2200 mj/cm$^2$.

Adhesive

After the curable coating 13 is cured to form a protective layer 13, an adhesive composition is applied on top of the protective layer 13. The resinous adhesive is preferably combined with a solvent to form an adhesive composition, although a solvent is not necessary. The flowable adhesive can be applied to the protective layer by known methods including direct gravure printing, reverse gravure printing, mayer rod application and screen printing. The preferred method is by reverse gravure printing.

After the adhesive composition is applied to the base film 11, the solvent is allowed to evaporate such that the remaining resinous material forms the adhesive layer 14. The solvent is evaporated under ambient conditions or by exposing the composition to heat (e.g., from a forced-air dryer). Although increased temperature reduces the time required to evaporate the solvent, higher temperatures are more likely to deform or distort the base film. On the other hand, at lower temperatures, the composition requires more time to dry and the composition is more likely to dry incompletely.

The solvent should be capable of dissolving the resinous adhesive material. Although water-based compositions or solventless formulations can be used, the composition preferrably includes an organic solvent. Examples of suitable solvents include toluene, ethyl acetate, methyl isobutyl ketone, cellosolve acetate, methylene chloride, tetrahydrofuran, acetone, nitromethane, nitroethane, etc. Preferred solvents include toluene, methyl ethyl ketone and ethyl acetate. Methyl ethyl ketone is the most preferred solvent because it meets toxicity, flammability, solubility and drying requirements. Preferably, the solvent evaporates in about 1 to about 10 seconds at a temperature from about 50° C. to about 200° C., more preferably about 2 to 5 seconds at a temperature from about 70° C. to about 150° C., more preferably about 80° C. to about 120° C.

The relative amounts of resin and solvent in the adhesive composition can vary, depending on the desired viscosity of the adhesive composition and the desired drying time (i.e., the amount of time required for the solvent to evaporate from the adhesive composition). Preferably, the adhesive composition has a viscosity that is low enough such that the composition is capable of flowing and becoming evenly distributed upon application to the protective layer 13. However, energy and time are wasted evaporating excessive solvent. Furthermore, excess solvent can reduce the thickness of the dry release layer. The desired viscosity can also vary depending on the method by which the adhesive composition is applied to the protective layer 13. For example, when the adhesive composition is applied by gravure printing a preferred viscosity is about 10 centipoise to about 300 centipoise, more preferably about 50 centipoise to about 150 centipoise. In reverse gravure printing, the adhesive solution preferably has a viscosity of about 25 cps to about 50 cps (when using a 150 trihelical cylinder) to provide an adhesive layer approximately 0.8 pm thick. In contrast, when the adhesive composition is applied by screen printing a preferred viscosity is about 500 to about 5000 centipoise, more preferably about 1000 centipoise to about 3000 centipoise.

Typically, the adhesive composition includes about 5 wt % (wet) to about 30 wt % (wet) resin, more preferably about 10 wt % (wet) to about 20 wt % (wet) resin. Most preferably, the adhesive composition includes about 10 wt % (wet) to about 15 wt % (wet) resin and about 85 wt % (wet) to about 90 wt % (wet) solvent.

B. Two Step Curing Process

In a second embodiment, a protective film 10 is made using a 2-step curing process. As with the first embodiment, a release composition is applied to a base film 11 as a solution using conventional coating methods (if a release layer 12 is desired). The release composition is allowed to dry and form a release layer 12 on the base film 11. After the release layer 12 is dry, a curable composition is applied on top of the release layer 12 (if present) and allowed to dry. In contrast to the first embodiment, the curable coating 13 is then "partially cured". An adhesive composition is applied as a solution on top of the partially cured curable coating 13. The solvent in the adhesive composition is evaporated to form the adhesive layer 14. After the adhesive layer 14 is formed, the curable coating 13 is "fully cured" to form a protective layer 13. Thus, in the second embodiment, the adhesive layer 14 commingles with the protective layer 13 at the interface of these two layers. The commingling provides additional integrity to the protective coating 16, and additional adhesion of the adhesive layer 14 to the protective layer 13.

As described above, "cure" refers to a process by which a polymerizable composition (e.g., monomers and/or oligomers) present in the curable composition become cross-linked. Preferably, the curable coating 13 is cured by exposure to U.V. radiation. Curing can be performed using a mercury vapor curing lamp set at about 200 to about 400 watts per lineal inch. Web speed is preferably about 60 fpm to about 200 fpm. Alternatively, metal halide and/or xenon lamps can be used to initiate curing.

The term "partially cured" means that the curable composition is exposed to a minimum dosage of ultraviolet radiation necessary to provide a tack free surface to the curable coating 13 (such that the resultant protective film 10 may be wound onto itself without the coating blocking to the backside of the base film 11). Essentially, the term "partially cured" means that the composition retains unreacted reactive sites that can be subsequently cured and cross-linked such that the resulting composition has even less unreacted reactive sites. Generally, the term "partially cured" means that about 5% to about 90%, more preferably about 20% to 90%, most preferably about 40% to about 80% of the reactive sites (e.g., C=C in acrylate monomers) remain unreacted and available for cross-linking. The proportion of reactive sites, such as C=C bonds in acrylate monomers, can be determined using infra red (IR) spectroscopy, and/or nuclear magnetic resonance (NMR), and/or electron spectroscopy for chemical analysis (ESCA).

Another way to determine whether the curable coating 13 is undercured is to perform a methyl ethyl ketone double rub test (Sutherland Ink Rub Tester, modified with a methyl ethyl ketone filled felt tipped pen carrying a 355 gram weight) after partial curing. A felt tipped pen filled with methyl ethyl ketone will break through a partially cured coating before 40 double rubs. In contrast, the pen will not break through a fully cured coating, even after 50 double rubs.

The dosage required for partial curing can easily be determined by one of skill in the art. The required dosage for partially curing the curable coating 13 is dependent on many factors, including the type of U.V. reflectors used, the use of IR filters, the amount and types of photoiniators used, coated film temperature, lamp manufacturer, the thickness of the curable coating 13, as well as the type of lamps and UV curing unit used. Generally, for partial curing, the curable coating 13 is exposed to about 500 mj/cm$^2$ to about 3000 mj/cm$^2$, more preferably about 1100 mj/cm$^2$ to about 2100 mj/cm$^2$ of energy. Due to variations in lamps and reflectors, these energy values for partial curing of the coating may overlap with the energy values for fully curing the coating. One of skill in the art is able to determine the proper energy level for a specific composition and curing unit within the ranges provided. For example, one pass on an Eye Ultraviolet curing unit using 200 watts/inch lamp at 75 fpm will result in a partially cured protective coating, whereas two passes at 75 fpm will result in a fully coating. Alternatively, using a Prime UV curing unit and a 200 watts/inch lamp, a partial cure can be obtained by one pass at 100 fpm and a full cure with a second pass at 200 fpm.

After the curable coating 13 is partially cured, an adhesive composition is applied in a manner similar to that described in connection with the one-step curing method. Because the curable coating 13 was undercured prior to application of the adhesive layer, the solvent in the adhesive composition commingles with the surface of the partially cured curable coating 13. The corningling of the two coatings provides additional bonding strength between the adhesive layer 14 and the protective layer 13.

After the adhesive composition is dried and forms an adhesive layer, the partially formed protective film is again exposed to U.V. radiation to "fuilly cure" the curable coating 13. Due to the commingling of the adhesive composition and the partially cured curable coating 13, the resulting flilly cured protective layer 13 is crosslinked with the adhesive layer 14.

III. Method of Making a Protected data carrying Device

Once formed (using either the one step or two step method), the protective film 10 has a layered configuration as shown in FIG. 1. The protective coating 16 (i.e., the release layer 12, the protective layer 13 and the adhesive layer 14) can be easily transferred from the base film 11 to a polymeric substrate 15 using heat and pressure (e.g., a conventional heat lamination process). The resulting data carrying device 18 has a layered configuration as shown in FIG. 2. Advantageously, an end user can apply the protective coating 16 of the invention to a polymeric substrate 15 without exposure to harsh chemicals or ultraviolet radiation and without the need for complex and/or expensive ultraviolet (U.V.) curing equipment. However, the final protective coating has abrasion resistance properties of conventional U.V. curable coatings. Furthermore, the protective coating 16 of the invention can be applied to a polymeric substrate 15 in multiple layers for additional protection, such that the resulting protected data carying device 18 has the layered configuration shown in FIG. 4.

According to the invention, a protected data carrying device is prepared by adhering the protective coating 16 of the invention to a polymeric substrate 15. To transfer the protective coating 16 from the base film 11 to the polymeric substrate, the protective film 10 is positioned such that the adhesive layer 14 is adjacent the polymeric substrate 15. The protective film 10 is then adhered to the polymeric substrate 15, preferably by conventional lamination methods. Generally, in lamination processes, a heated roller presses against the backside of the base film 11 to heat the adhesive layer 14 to a temperature wherein the resins become tacky and adhere to the polymeric substrate 15. Pressure can also be applied by the heated roller to enhance bonding of the adhesive layer 14 to the polymeric substrate 15. After lamination, the base film 11 is stripped away from the protective coating 16 revealing a polymeric substrate 15 that is protected with the protective coating 16.

Generally, the heated roller is used at a temperature of about 150° C. to about 220° C. and pressure of about 400 psi to about 800 psi, more preferably a temperature of about 170° C. to about 190° C. and pressure of about 500 psi to about 700 psi. Preferably, lamination is accomplished using nip rollers, one of which is heated.

Optionally, multiple layers of the protective coating 16 can be applied to a polymeric substrate 15. Although one layer of the protective coating 16 is sufficient for most data carrying devices, more than one layer can be added for additional protection. Many factors determine the amount of protection a user requires for a carrying device. Cost is normally the number one restraint for card protection. The more protective layers applied to a card carrying device, the more a card will cost. Typically, one or two layers of the protective coating 16 are applied, although more layers can be applied if desired. To add multiple layers of the protective coating, a second (or third or fourth . . . ) protective coating 16 is laminated to the release layer 12 of the first protective coating.

In one embodiment, the protective film 10 is die cut to the desired size (typically to a size having the same width and length as the polymeric substrate 15) prior to adhering the protective film 10 to the polymeric substrate. This method is preferred when the resins included in the protective film 10 have higher tensile strength and elongation. In an alternate embodiment, the protective film 10 is adhered to the polymeric substrate 15 with out being die cut to a desired size (e.g., not cut to a size having the same width and length as the polymeric substrate 15). As used herein, the terms "width" and "length" refer to the dimensions of the surface of the data carrying device 10 to on which printed matter is typically imprinted (e.g., not "thickness"). In yet another alternate embodiment, both the polymeric substrate and the protective coating could be oversized to allow for higher tensile strength and elongation of the protective coating 16. Then the protected data carrying device would be die cut to size.

In a further alternate embodiinent, the protective coat 13 and adhesive coat 14 could be applied to a film 11, which may or may not have a release coating 12, by some conventional print method such as screen printing or rotogravure or flexography. The print pattern would be identical to the in width and length size or nearly so as the polymeric substrate 15 to be protected. In this embodiment, the protective coating 13 could have a higher elevation of protection by increasing the tensile and elongation properties of the protective coating 13. The printed protective coating 16 would have to be properly aligned to the polymeric substrate 15 by some sort of position sensoring devices before heat laminating the protective coating 16 to the polymeric substrate 15.

IV. Protected data carrying Device

The protected data carrying devices of the invention are stable and exhibit improved physical properties, such as plasticiser resistance, U.V. resistance, abrasion resistance, and/or overall durability when compared with data carrying devices that do not include the protective film of the invention. A protected data carrying device 18 of the invention generally includes a polymeric substrate 15 and a protective coating 16. Advantageously, multiple layers of the protective coating 16 can be applied to the data carrying device 18. Exemplary cross-sections of a data carrying device 18 prepared according to the invention are shown in FIGS. 3 and 4.

Polymeric substrate 15 functions as the primary structural component of the data carrying device 18. Polymeric substrate 15 is typically made from a hard, rigid polymer and generally provides a substrate onto which inks providing color and identifying information are applied. Polymeric substrate 15 can include any type of polymer that provides structural integrity and stability to the data carrying device 18. Polymeric substrate 15 should also be capable of retaining inks and other identifying information. Furthermore, polymeric substrate 15 should be capable of withsttnding lamination conditions without adversely affecting its properties. Generally polymers such as polyvinyl chloride (PVC), acrylonitrile butadiene styrene terpolymer (ABS), polyesters, polycarbonates, and co-polymers thereof are suitable for use as a polymeric substrate 15.

The polymeric substrate 15 can be a polymeric laminate or an extruded or injection molded one piece design. Most credit cards use a laminated substrate of polyvinyl chloride (PVC) sheets wherein two 10–13 mil thick sheets of white PVC are heated laminated together. The PVC sheets are then printed with graphics on one or both sides. The printed or non-printed sheets are then heat laminated with clear vinyl film (about 2–4 mil thick) on each side. Another example of a polymeric substrate 15 is acrylonitrile butadiene styrene (ABS). This polymeric substrate is typically used in smart cards or phone cards. ABS is usually extruded or injection molded. The substrate can be printed with graphics and varnished before customizing. Other polymeric substrates include polycarbonate or polyester composites or polyolefin type cards such as tyvek. Most preferably, PVC or a polyester, such as polyethylene terephthalate, are included in polymeric substrate 15.

Polymeric substrate 15 can and preferably does have printed matter thereon, including a person's name, address, account number, or even a picture. The inks or other identifying information can be applied at various stages during the card manufacturing process using a variety of methods. The printed matter is applied to the substrate using techniques known in the art, such as thermal transfer, dye sublimation, ink jet printing, laser printing, dye diffusion printing. Identifying information can also be applied by embossing, for example. After the card substrate is customized for a particular customer the item is then protected with a protective coating 16 according to the methods described above.

A polymeric substrate 15 to which multiple layers of the protective coating 16 are applied (FIG. 4) displays a substantial improvement in protection when compared to a data carrying device that has been laminated with a conventional protective coating. For example, solvent resistance (using the double rub test described above) improves about 10 to about 20 fold (e.g., 10 double rubs to over 200 double rubs). Resistance to plasticiser doubles (e.g., improves from 24 hours to 48 hours). Resistance to plasticiser can be determined by coating dioctyl phthalate onto the data carrying device after it is stressed in a flexing machine for 300 cycles in each dimensional direction. The data carrying device is then placed in a 50° C. oven and observed for degradation of printed graphics. Abrasion resistance improves 60% (e.g., from 625 cycles to 1000 cycles using the 5150 Abraser from Taber Industries). UV resistance improves from 80% color retention to 90% color retention. U.V. resistance is determined by measuring the reflection density of a printed device before and after exposing the data carrying devices in a QUV accelerated weathering unit for one week. Black, yellow, magenta and cyan color dots printed on the data carrying device are measured for reflective density with a MacBeth RD915 densitometer.

What is claimed is:

1. A method for preparing a protective film useable in preparing a prcgected data carrying device, said method comprising steps of:

(a) providing a base film;

(b) applying a curable composition to the base film wherein the curable composition dries to form a curable coating;

(c) partially curing the curable coating;

(d) applying an adhesive composition to the partially cured curable coating, wherein the adhesive composition dries to form an adhesive layer; and (e) fully curing the curable coating to form a protective film comprising the fully cured coating and the adhesive composition, wherein the protective film is releasable from the base film.

2. The method of claim 1, further comprising the step of applying a release composition to the base film prior to applying the curable composition wherein the release composition forms a release layer and wherein the curable composition is applied to the release layer.

3. The method of claim 1, further comprising a step of applying a release composition to the base film, prior to application of the curable composition to the base film, wherein the release composition forms a release layer and wherein the curable composition is then applied to the release layer.

4. The method of claim 3 wherein the release composition further comprises a solvent.

5. The method of claim 4 wherein the solvent is evaporated to form the release layer.

6. The method of claim 5 wherein the solvent is evaporated under ambient conditions.

7. The method of claim 5 wherein the solvent is evaporated at a temperature between about 50° C. and about 200° C.

8. The method of claim 4 wherein the solvent is selected from the group consisting of toluene, ethyl acetate, methyl isobutyl ketone, cellosolve acetate, methylene chloride, tetrahydrofuran, acetone, nitromethane, nitroethane, and mixtures thereof.

9. The method of claim 4 wherein the solvent includes an organic solvent.

10. The method of claim 3 wherein the release composition further comprises a wax.

11. The method of claim 10 wherein the wax is selected from the group consisting of polymeric wax, polyethylene, polyolefin, polytetrafluoroethylene, natural wax, and a mixture thereof.

12. The method of claim 3 wherein the release composition further comprises an ultraviolet absorber additive.

13. The method of claim 3 wherein the release composition is applied by gravure printing, mayer rod metering, reverse roll, slot die, curtain coating, or screen printing.

14. The method of claim 13 wherein the release composition is applied by direct gravure printing.

15. The method of claim 3 wherein the curable composition comprises a polymerizable composition.

16. The method of claim 15 wherein the polymerizable composition includes diacrylate or triacrylate monomers or oligomers, or a mixture thereof.

17. The method of claim 15 wherein the curable composition further comprises a solvent.

18. The method of claim 17 wherein the solvent is evaporated to form the curable coating.

19. The method of claim 18 wherein the solvent is evaporated under ambient conditions.

20. The method of claim 18 wherein the solvent is evaporated at a temperature between about 50° C. and about 200° C.

21. The method of claim 15 wherein the curable composition further comprises a polymerization initiator.

22. The method of claim 1 wherein the base film comprises polyester, polyamide, polypropylene, polyethylene, polycarbonate, polyethylene naphthalate, mixtures and copolymers thereof.

23. The method of claim 3 wherein the release composition comprises a resin selected from the group consisting of acrylic, acrylate, methacrylate, polyester, polyvinyl butyral, cellulose acetate butyrate, cellulose acetate propionoate, polyvinyl acetate, polyvinyl chloride, mixtures and copolymers thereof.

24. The method of claim 1 wherein the adhesive layer includes a heat sealable adhesive.

25. The method of claim 1 wherein the adhesive composition comprises a resin selected from the group consisting of acrylic, ethyl methacrylate, butyl methacrylate, polyvinyl acetate, polyvinyl chloride, mixtures and copolymers thereof.

26. The method of claim 1 wherein the adhesive composition includes a solvent.

27. The method of claim 26 wherein the solvent includes an organic solvent.

28. The method of claim 26 wherein the solvent is selected from the group consisting of toluene, ethyl acetate, methyl isobutyl ketone, cellosolve acetate, methylene chloride, tetrahydrofuran, acetone, nitromethane, nitroethane, and a mixture thereof.

29. The method of claim 26 wherein the solvent is evaporated to form the adhesive layer.

30. The method of claim 29 wherein the solvent is evaporated under ambient conditions.

31. The method of claim 29 wherein the solvent is evaporated at a temperature between about 50° C. and about 200° C.

32. The method of claim 1 wherein the curable composition comprises reactive groups and the step of partially curing comprises curing the curable composition until between about 5% and 90% of the reactive sites are unreacted.

33. The method of claim 1 wherein the curable composition comprises reactive groups and the step of partially curing comprises curing the curable composition until between about 20% and 90% of the reactive sites are unreacted.

34. The method of claim 1 wherein the curable composition comprises reactive groups and the step of partially curing comprises curing the curable composition until between about 40% and 80% of the reactive sites are unreacted.

* * * * *